US006748906B1

(12) United States Patent
White et al.

(10) Patent No.: US 6,748,906 B1
(45) Date of Patent: Jun. 15, 2004

(54) HEAT EXCHANGER ASSEMBLY FOR A MARINE ENGINE

(75) Inventors: Brian R. White, Stillwater, OK (US); Vince E. Notareschi, Stillwater, OK (US); John A. Voit, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 14 days.

(21) Appl. No.: 10/133,070

(22) Filed: Apr. 26, 2002

(51) Int. Cl.[7] ..... F01P 9/00
(52) U.S. Cl. ..... 123/41.01
(58) Field of Search ..... 123/41.01, 41.14, 123/41.31, 41.74, 41.08, 41.44, 41.09, 41.29, 41.48, 41.8; 165/41, 51

(56) References Cited

U.S. PATENT DOCUMENTS 3,780,715 A 12/1973 Flitz ..... 123/122
4,214,443 A * 7/1980 Herenius ..... 60/321
4,220,121 A * 9/1980 Maggiorana ..... 123/41.8
4,258,687 A 3/1981 Mauch et al. ..... 123/570
4,759,181 A * 7/1988 Biritz ..... 60/321
5,004,042 A * 4/1991 McMorries et al. ..... 165/41
5,309,885 A 5/1994 Rawlings et al. ..... 123/509
5,746,270 A * 5/1998 Schroeder et al. ..... 165/41

* cited by examiner

*Primary Examiner*—Henry C. Yuen
*Assistant Examiner*—Hyder Ali
(74) *Attorney, Agent, or Firm*—William D. Lanyi

(57) ABSTRACT

A heat exchanger for a marine internal combustion engine is disposed between first and sides of a V-shaped engine configuration. A plurality of tubes and related structure are disposed within a cavity formed as an integral part of an air intake manifold of the engine. A first cooling fluid, such as ethylene glycol, is circulated in thermal communication with outer surfaces of the plurality of tubes within the heat exchanger and a second cooling fluid, such as lake or sea water, is circulated through the internal passages of the plurality of tubes. A conduit is provided within an end portion of the heat exchanger to remove heat from a lubricant, such as oil, of the internal combustion engine.

18 Claims, 4 Drawing Sheets

HEAT EXCHANGER ASSEMBLY FOR A MARINE ENGINE

BACKGROUND OF THE INVENTION

1. Field of the Invention

The present invention is generally related to a heat exchanger for a marine engine and, more particularly, to a heat exchanger that is integral with an air intake manifold of a V-type engine.

2. Description of the Prior Art

U.S. Pat. No. 5,309,885, which issued to Rawlings et al on May 10, 1994, describes a marine propulsion device including a fuel injected four-cycle internal combustion engine. The internal combustion engine comprises an engine block including a combustion chamber, a fuel vapor separator, a fuel supply mechanism for introducing fuel to the combustion chamber, a conduit communicating between the fuel vapor separator and the fuel supply mechanism for introducing fuel, and a cooling jacket for cooling the fuel vapor separator.

U.S. Pat. No. 3,780,715, which issued to Flitz on Dec. 25, 1973, describes an early fuel evaporation intake manifold. The manifold is provided for an internal combustion engine and includes a low thermal mass, thin metal gasket plate clamped between upper and lower manifold castings and having an integral heat exchanger forming the floor of the riser bore plenum. The gasket plate and cored channel in the lower manifold casting define an exhaust crossover passage having a vertical run incident to the heat exchanger and flaring to a restrictive high aspect-ratio heat transfer duct coextensive with the heat exchanger. The exhaust gases are directly against the heat exchanger at the vertical run and accelerate through the restrictive duct to break up the stagnant fluid film at the heat exchanger or effecting rapid heating thereof to promote greater fuel vaporization during engine warmup.

U.S. Pat. No. 4,258,687, which issued to Mauch et al on Mar. 31, 1981, describes an engine with an integral mounted EGR cooler. An automotive type V-8 engine has an exhaust gas recirculation system wholly contained within its intake manifold, and a flat, sandwich type EGR cooler is constructed in be integrally mounted to the underside of the manifold in the valley of V-8 over the combination valley cover-manifold gasket, without the use of hoses, clamps and other paraphernalia normally associated with externally mounted EGR coolers.

The patents described above are hereby expressly incorporated by reference in the description of the present invention.

In marine engine applications, in which a closed cooling system is provided, the coolant within the closed cooling system is typically cooled through the use of lake or sea water. To accomplish this, a heat exchanger is provided. It would be significantly beneficial if a structure could be provided in which the heat exchanger is disposed in a compact configuration.

SUMMARY OF THE INVENTION

A cooling system for a marine propulsion system, made in accordance with a preferred embodiment of the present invention, comprises an internal combustion engine having a plurality of cylinders, with the plurality of cylinders being disposed in a V-shaped configuration with at least a first one of the plurality of cylinders being disposed on a first side of the V-shaped configuration and at least a second one of the plurality of cylinders being disposed on a second side of the V-shaped configuration. A cooling passage is formed within the internal combustion engine to conduct a first cooling fluid in thermal communication with a heat producing component of the internal combustion engine. The heat exchanger is connected in fluid communication with the coolant passage and in fluid communication with a source of a second cooling fluid. The heat exchanger is configured to conduct the first and second cooling fluids in thermal communication with each other. The heat exchanger is disposed between the first and second sides of the V-shaped configuration of cylinders.

The heat exchanger comprises a plurality of tubes within which the second cooling fluid is conducted. The first cooling fluid is conducted within a cavity of the heat exchanger external to the outer surfaces of the plurality of tubes. The first cooling fluid is conducted to flow within a closed circuit comprising the heat exchanger and the cooling passage formed within the internal combustion engine.

In certain embodiments of the present invention, a conduit is disposed within the heat exchanger and in thermal communication with the second cooling fluid. The conduit is connected in fluid communication with a lubrication system of the internal combustion engine in order to conduct a liquid lubricant through the conduit in thermal communication with the second cooling fluid. The conduit comprises a helical tubular structure disposed in an end portion of the heat exchanger in one embodiment of the present invention.

The present invention can further comprise an intake manifold disposed at least partially between the first and second sides of the V-shaped configuration of cylinders. A cavity is formed within the intake manifold and shaped to receive the heat exchanger therein. The heat exchanger is disposed within the cavity formed within the intake manifold, whereby an internal surface of the cavity serves as an outer shell of the heat exchanger.

In the preferred embodiment of the present invention, heat is transferred from the first cooling fluid to the second cooling fluid within the heat exchanger. The second cooling fluid is water which is drawn from a body of water, such as a lake or ocean in which the marine propulsion system is operated. The plurality of tubes is disposed along an axis which is generally parallel to a crankshaft of the internal combustion engine in a particularly preferred of the present invention.

BRIEF DESCRIPTION OF THE DRAWINGS

The present invention will be more fully and clearly understood from a reading of the description of the preferred embodiment in conjunction with the drawings, in which.

DESCRIPTION OF THE PREFERRED EMBODIMENT

Figure 1A:
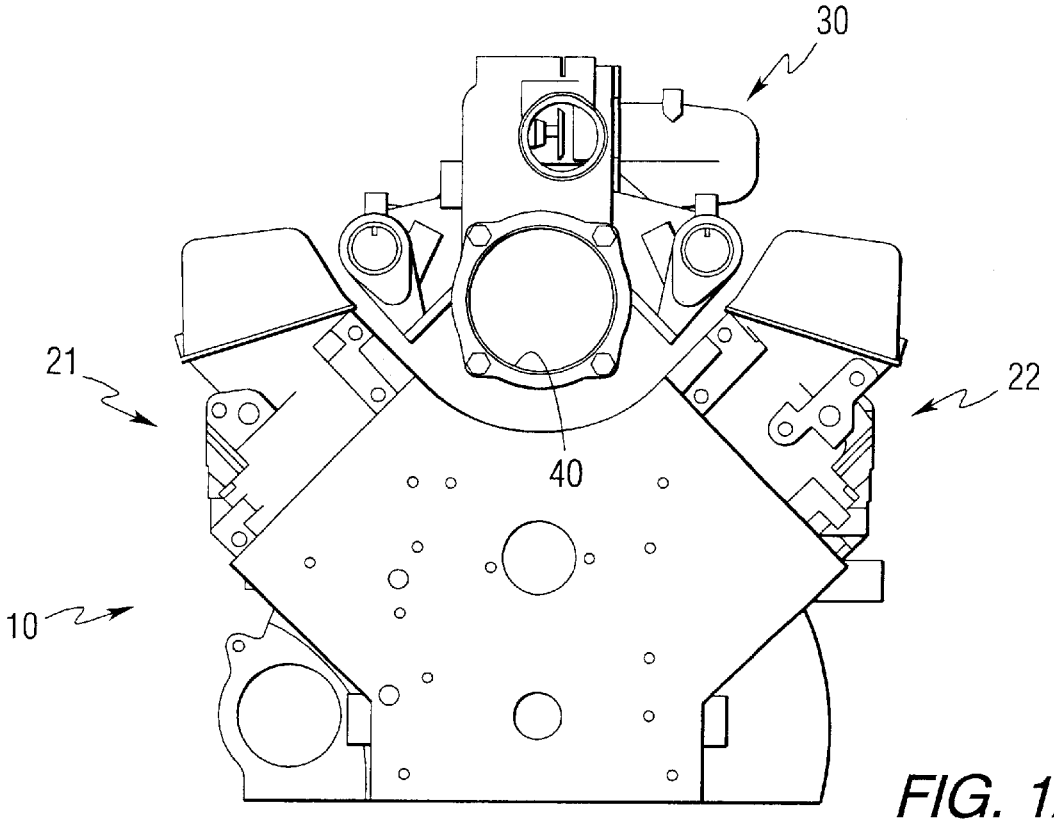
FIGS. 1A and 1B are two planer end views of an internal combustion engine comprising the present invention.

Throughout the description of the preferred embodiment of the present invention, like components will be identified by like reference numerals.

FIG. 1 A shows an end view of an internal combustion engine 10 having a plurality of cylinders with the plurality of cylinders being disposed in a V-shaped configuration. A first group of cylinders is disposed on a first side 21 and a second group of cylinders is disposed on a second side 22. Although not particularly illustrated in FIG. 1, it is well known to those skilled in the art that internal combustion engines are provided with one or more coolant passages formed within the engine block to conduct a first cooling fluid, such as ethylene glycol, in thermal communication with heat producing components of the internal combustion engine 10.

In FIG. 1A, an intake manifold structure 30 is shown separated, for the purpose of illustration, from the engine block of the internal combustion engine 10. The intake manifold 30 is disposed at least partially between the first and second sides, 21 and 22, of the V-shaped configuration of cylinders of the internal combustion engine 10. A cavity 40 is formed within the intake manifold 30 and shaped to receive and serve as a housing for a heat exchanger which will be described in greater detail below.

Figure 1B:
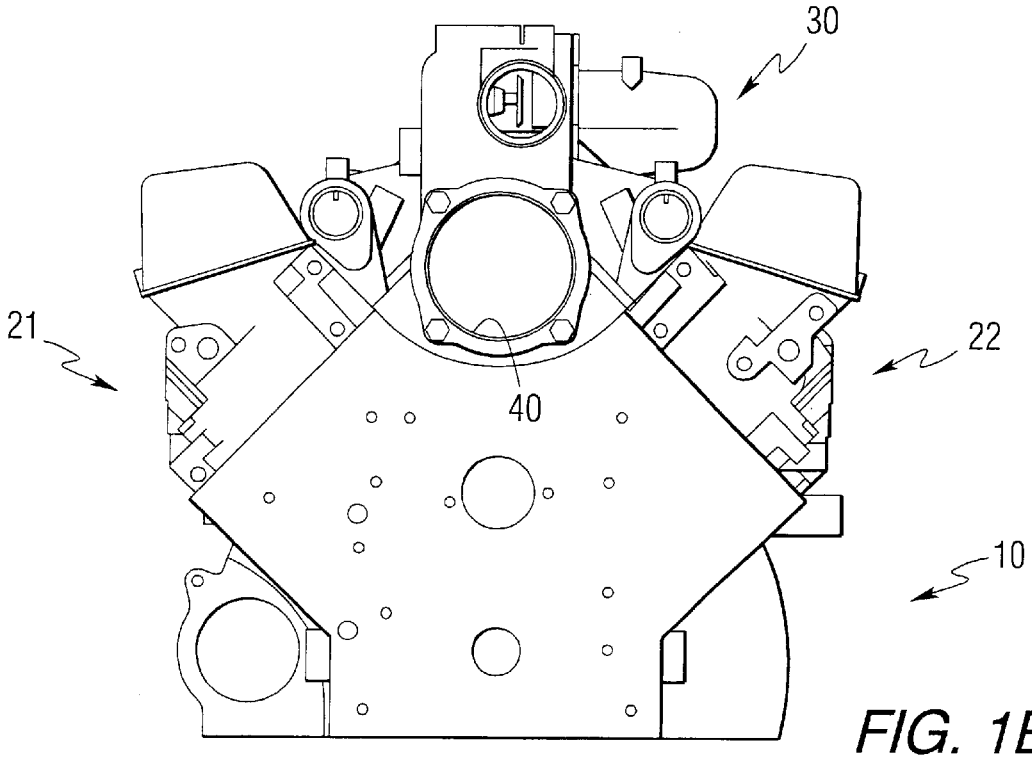

FIG. 1B shows the air intake manifold 30 attached to the internal combustion engine 10. Passages within the air intake manifold 30 are connected in fluid communication with intake valves of the cylinders on the first and second sides, 21 and 22, of the engine. The cavity 40 is generally cylindrical and extends along a central axis that is generally parallel to a crankshaft of the internal combustion engine 10.

Figure 2B:
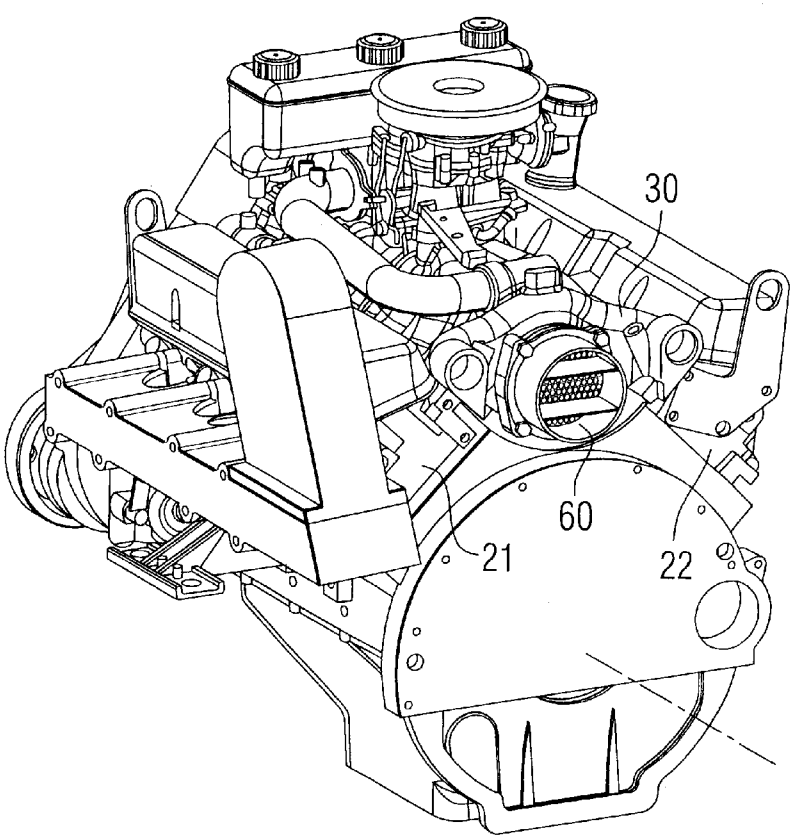
FIGS. 2A and 2B are two isometric views of an internal combustion engine comprising the present invention.
Figure 2A:
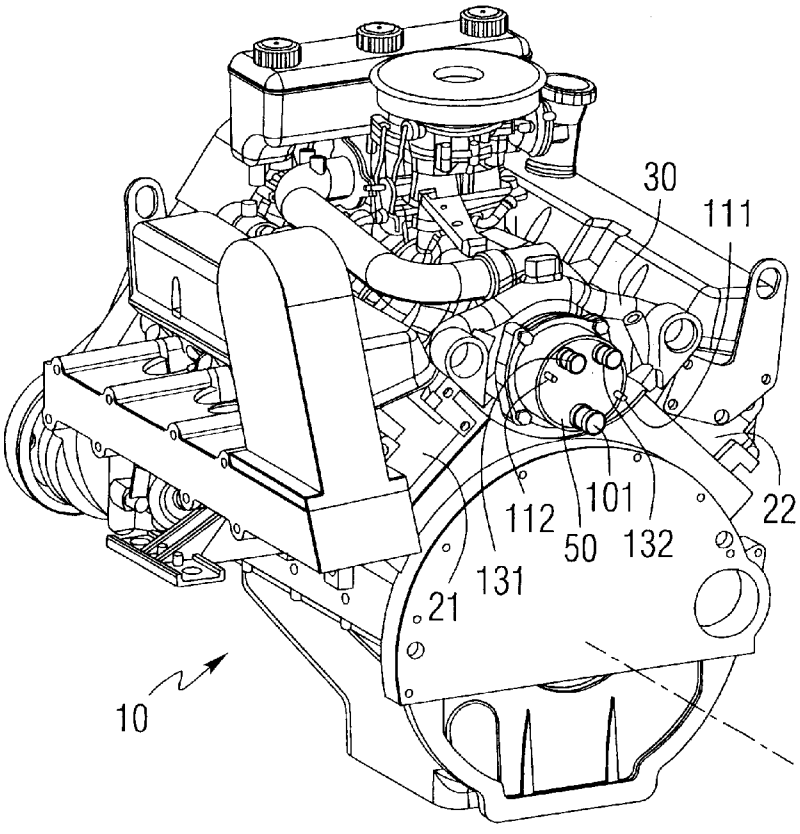

FIG. 2A is an isometric view of the engine 10 with a heat exchanger disposed within the cavity 40 described above in conjunction with FIGS. 1A and 1B. In FIG. 2A, the end cover 50 of the heat exchanger is visible.

FIG. 2B is generally similar to FIG. 2A, but the end cap removed from the heat exchanger. As can be seen, the heat exchanger 60 is disposed between the first and second sides, 21 and 22, of the internal combustion engine.

Figure 3:
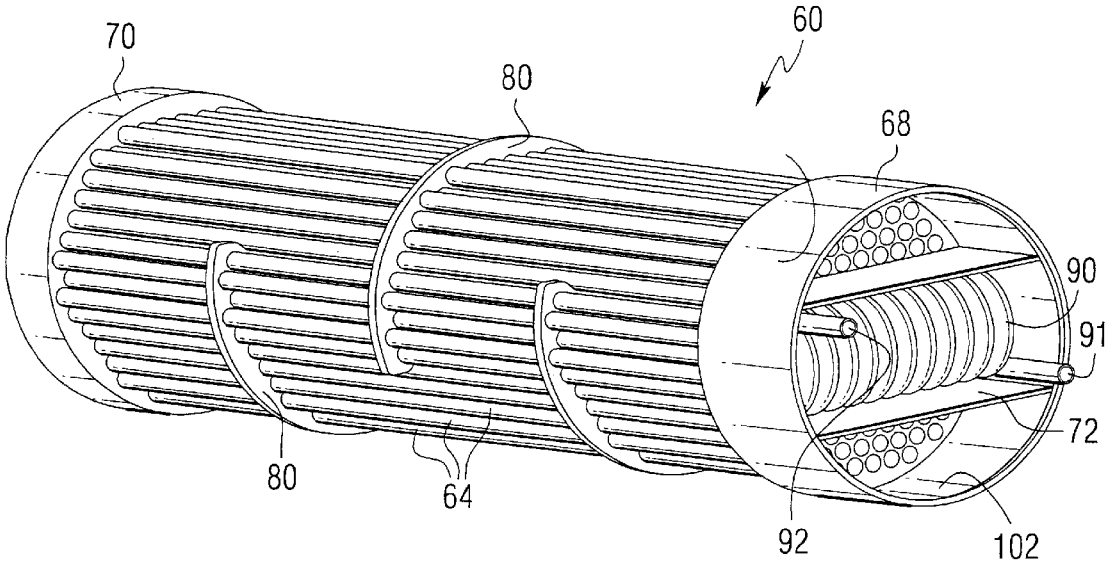
FIG. 3 is an isometric view of a heat exchanger.

With reference to FIGS. 1A, 1B, 2A, 2B, and 3, FIG. 3 shows the internal portion of the heat exchanger 60 removed from the cavity 40 of the air intake manifold 30. In FIGS. 2A, 2B, and 3, it can be seen that the heat exchanger 60 comprises a plurality of tubes 64 and the cavity 40 serves as an outer shell or housing component of the heat exchanger 60.

In a closed cooling system, the first cooling fluid is circulated through the coolant passage of the internal combustion engine 10, in a manner well known to those skilled in the art, in order to allow heat generated by the heat producing components of the engine to flow into the first cooling fluid and be removed. The first cooling fluid, such as ethylene glycol, is directed to flow in thermal communication with the outside surfaces of the plurality of tubes 64. A second cooling fluid, such as lake or sea water, is caused to flow through the tubes 64 by entering a preselected end portion 68 of the heat exchanger 60. As will be described in greater detail below, the water is directed along several paths which each comprise certain preselected tubes 64. In a manner generally known to those skilled in the art, the end structures, 68 and 70, of the heat exchanger 60 direct the water flow in a generally serpentine pattern. This serpentine is accomplished by baffles 72 that are provided in both end portions, 68 and 70, of the heat exchanger 60. It should be understood that the particular path of the second cooling fluid through the heat exchanger 60 is not limiting to the present invention.

When the heat exchanger 60 is inserted into the cavity 40 of the air intake manifold 30, the space within the cavity 40 and surrounding the outside surfaces of the tubes 64 provide a fluid conduit that directs the second cooling fluid in thermal communication with the tubes 64. The baffles 80 are provided to require that the first cooling fluid travel along a serpentine path within the cavity 40 and in contact with the outer surfaces of the tubes 64. This assures good thermal communication between the first cooling fluid flowing in contact with the outside surfaces of the tubes 64 and the second cooling fluid flowing within the inside portions of the tubes 64. The first cooling fluid, such as ethylene glycol, is conducted to flow within a closed circuit which comprises the space between the internal cylindrical wall of the cavity 40 and the outside surfaces of the tubes 64 and also comprises the coolant passage within the engine block.

In one embodiment of the present invention, an oil cooler conduit 90 is disposed within the heat exchanger 60 and in thermal communication with the second cooling fluid, such as lake or sea water. The conduit is connected in fluid communication with a lubrication system of the engine in order to conduct a liquid lubricant, such as oil, through the conduit 90 and in thermal communication with the second cooling fluid, such as lake or sea water. The conduit 90 shown in FIG. 3 is a helical tubular structure that is disposed in the end portion 68 of the heat exchanger 60.

Figure 4:
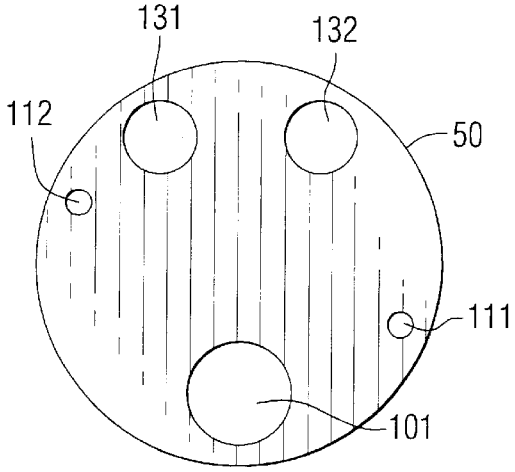
FIG. 4 is a schematic representation of the openings in an end cap of the heat exchanger.

FIG. 4 shows the relative positions of the ends of several conduits extending through the end cap 50 of the heat exchanger 60. The second cooling fluid, such as lake or sea water, is introduced into opening 101. The second cooling fluid then flows into the bottom segment 102 of the end region 68 to begin its travel through the internal portions of the tubes 64. The second cooling fluid initially travels in a direction from end portion 68 to end portion 70 of the heat exchanger 60. The baffles at end portion 70 cause the water to return through the tubes 64 along the length of the heat exchanger 60. The second cooling fluid then flows in thermal communication with the conduit 90 to remove heat from the lubrication fluid flowing through conduit 90 from its first end 91 to its second end 92. The first and second ends, 91 and 92, of the conduit 90 extend through holes 111 and 112 of the end cap 50, as shown in FIG. 4. This allows the lubricant, such as oil, to be introduced into the end cap 50 and flow in thermal communication with the second cooling fluid within the end portion 68 of the heat exchanger 60. The lubricant then flows out of the end cap 50 through opening 112 which is associated with the second end 92 of the conduit 90. In FIG. 4, holes 131 and 132 are connectable in fluid communication with water passages formed in the exhaust elbows of the internal combustion engine 10. After flowing through the exhaust elbows, the second cooling fluid is returned to the lake or sea from which it was originally drawn.

Figure 5:
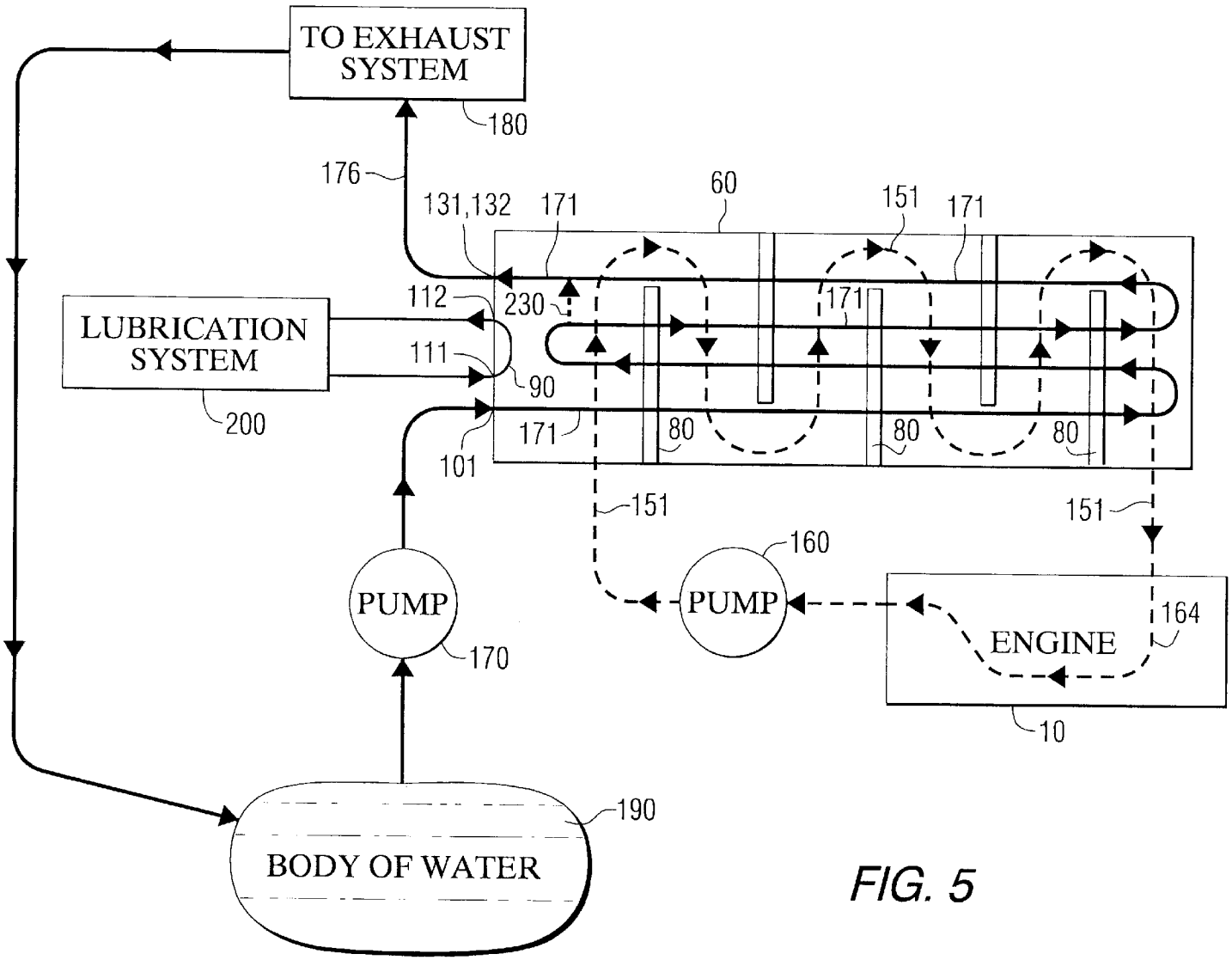
FIG. 5 is a hydraulic schematic showing the fluid paths of the first and second cooling fluids.

FIG. 5 is a schematic representation of the fluid circuits for both the first and second cooling fluids. The first cooling fluid, which is typically ethylene glycol, is caused to flow along the path represented by dashed lines 151. The first cooling fluid is pumped by a circulation pump 160 through a closed cooling circuit that comprises the heat exchanger 60 and the cooling passage 164 that causes the first cooling fluid to flow in thermal communication with heat producing components of the engine 10. The path 151 of the first cooling fluid flows in contact with the outer surfaces of the plurality of tubes 64 described above in conjunction with FIG. 3.

With continued reference to FIG. 5, a sea water pump 170 draws water from a body of water 190, such as a lake or sea, in which the marine engine is operating and pumps the water into opening 101 of the heat exchanger 60. The water flows along the serpentine path through selected ones of the plurality of tubes 64 shown in FIG. 3. Appropriate baffling contained in the end portions, 68 and 70, of the heat exchanger 60 cause the water to turn within the end portions and enter preselected tubes for return flow in an opposite direction through the heat exchanger 60. After making the four illustrative passes in directions generally parallel to the central axis of the heat exchanger 60, the water exits through openings 131 and 132 and is directed by conduit 176 to the exhaust system 180 of the marine engine. Typically, the water flowing from openings 131 and 132 is directed to the exhaust elbows of the marine engine when the marine engine has a closed cooling system as described herein. After passing through the exhaust elbows of the marine propulsion system, the water is returned back to the body of water 190.

With continued reference to FIG. 5, the lubrication system 200 of the marine propulsion system is provided with a conduit that conducts the lubricant to opening 111 and through conduit 90. This causes the lubricant to flow through the conduit 90 and in thermal communication with the water within the end portion 68 of the heat exchanger 60. The lubricant then exits from the heat exchanger 60 through opening 112 to return to the lubrication system 200 of the engine and its associated components. The passage of the lubricant through conduit 90 reduces the temperature of the lubricant. Some of the second cooling fluid drawn from the body of water 190 is conducted through a bypass shunt 230 within the heat exchanger 60 and flows more directly to openings 131 and 132. The bypass shunt 230 is provided for draining purposes and is not directly related to the present invention.

With reference to FIGS. 1A, 1B, 2A, 2B, and 3–5, it can be seen that a cooling system for a marine propulsion system, made in accordance with the preferred embodiment of the present invention, comprises an internal combustion engine 10 which has a plurality of cylinders in which the plurality of cylinders are configured on a first side 21 and a second side 22 of the engine. This creates a V-shaped configuration. The internal combustion engine 10 has a cooling passage formed within it to conduct a first cooling fluid, such as ethylene glycol, in thermal communication with heat producing components of the internal combustion engine 10. A heat exchanger 60 is connected in fluid communication with the cooling passage 164 and also in fluid communication with a source of a second cooling fluid, such as lake or sea water. The heat exchanger 60 is configured to conduct the first and second cooling fluids in thermal communication with each other. The heat exchanger 60 is disposed in the cavity 40 between the first and second sides, 21 and 22, of the V-shaped configuration of cylinders of the internal combustion engine 10. The heat exchanger 60 comprises a plurality of tubes 64 within which the second cooling fluid is conducted. The first cooling fluid is conducted within a cavity 40 of the heat exchanger 60 external to the outer surfaces of the plurality of tubes 64. The cavity of the heat exchanger is defined by the generally cylindrical opening formed in the air intake manifold 30. The first cooling fluid is conducted to flow within a closed circuit comprising the heat exchanger 60 and the coolant passage 164 of the engine 10. A conduit 90 is disposed within the heat exchanger 60 and in thermal communication with the second cooling fluid. The conduit 90 is connected in fluid communication with a lubrication system 200 of the internal combustion engine in order to conduct a liquid lubricant, such as oil, through the conduit 90 in thermal communication with the second cooling fluid within the end portion 68 of the heat exchanger 60. The conduit 90 can comprise a helical tubular structure disposed within the end portion 68, as illustrated in FIG. 3. An air intake manifold 30 is disposed at least partially between the first and second sides, 21 and 22, of the V-shaped configuration of cylinders of the engine 10. A cavity 40 formed within the intake manifold 30 is shaped to receive the heat exchanger 60 therein. The heat exchanger 60 is disposed within the cavity 40 formed within the intake manifold, whereby an internal surface of the cavity 40 serves as an outer shell of the heat exchanger 60. Heat is transferred from the first cooling fluid, such as ethylene glycol, to the second cooling fluid, such as lake or sea water, within the heat exchanger 60. Typically, the second cooling fluid is water which is drawn from a body of water 190 in which the marine propulsion system is operated. As shown in FIGS. 2B and 3, the plurality of tubes 64 is disposed along an axis which is generally parallel to the axis of a crankshaft of the internal combustion engine.

It should be noted that the tube bundle of the heat exchanger can be serviced from the front of the engine. In addition, the tube bundle of the heat exchanger is disposed, by the present invention, in an area that would otherwise not serve as useful of a purpose.

Although the present invention has been described in particular detail and illustrated to show a preferred embodiment, it should be understood that alternative embodiments are also within its scope.

We claim:

1. A cooling system for a marine propulsion system, comprising:

an internal combustion engine having a plurality of cylinders, said plurality of cylinders being disposed in a V-shaped configuration with at least a first one of said plurality of cylinders being disposed on a first side of said V-shaped configuration and at least a second one of said plurality of cylinders being disposed on a second side of said V-shaped configuration;

a coolant passage formed within said internal combustion engine to conduct a first cooling fluid in thermal communication with a heat producing component of said internal combustion engine; and a heat exchanger connected in fluid communication with said coolant passage and in fluid communication with a source of a second cooling fluid, said heat exchanger being configured to conduct said first and second cooling fluids in thermal communication with each other, said heat exchanger being disposed between said first and second sides of said V-shaped configuration of cylinders, said heat exchanger comprising a plurality of tubes within which said second cooling flow is conducted, said first cooling fluid being conducted within a cavity of said heat exchanger external to said plurality of tubes.

2. The cooling system of claim 1, wherein:

said first cooling fluid is conducted to flow within a closed circuit comprising said heat exchanger and said coolant passage.

3. The cooling system of claim 1, further comprising:

a conduit disposed within said heat exchanger and in thermal communication with said second cooling fluid.

4. The cooling system of claim 3, wherein:

said conduit is connected in fluid communication with a lubrication system of said internal combustion engine to conduct a liquid lubricant through said conduit in thermal communication with said second cooling fluid.

5. The cooling system of claim 3, wherein:

said conduit comprises a helical tubular structure disposed in an end portion of said heat exchanger.

6. The cooling system of claim 1, further comprising:

an intake manifold disposed at least partially between said first and second sides of said V-shaped configuration of cylinders; and a cavity formed within said intake manifold and shaped to receive said heat exchanger therein.

7. The cooling system of claim 6, wherein:

said heat exchanger is disposed within said cavity formed within said intake manifold, whereby an internal surface of said cavity serves as an outer shell of said heat exchanger.

8. The cooling system of claim 1, wherein:

heat is transferred from said first cooling fluid to said second cooling fluid within said heat exchanger.

9. The cooling system of claim 1, wherein:

said second cooling fluid is water drawn from a body of water in which said marine propulsion system is operated.

10. The cooling system of claim 1, wherein:

said plurality of tubes is disposed along an axis which is generally parallel to a crankshaft of said internal combustion engine.

11. A cooling system for a marine propulsion system, comprising:

an internal combustion engine having a plurality of cylinders, said plurality of cylinders being disposed in a V-shaped configuration with at least a first one of said plurality of cylinders being disposed on a first side of said V-shaped configuration and at least a second one of said plurality of cylinders being disposed on a second side of said V-shaped configuration;

a coolant passage formed within said internal combustion engine to conduct a first cooling fluid in thermal communication with a heat producing component of said internal combustion engine;

a heat exchanger connected in fluid communication with said coolant passage and in fluid communication with a source of a second cooling fluid, said second cooling fluid being water drawn from a body of water in which said marine propulsion system is operated, said heat exchanger being configured to conduct said first and second cooling fluids in thermal communication with each other, said heat exchanger being disposed between said first and second sides of said V-shaped configuration of cylinders, said heat exchanger being configured to conduct said first cooling fluid within a closed circuit comprising said heat exchanger and said coolant passage;

an intake manifold disposed at least partially between said first and second sides of said V-shaped configuration of cylinders; and a cavity formed within said intake manifold and shaped to receive said heat exchanger therein.

12. The cooling system of claim 11, wherein:

said heat exchanger comprises a plurality of tubes within which said second cooling flow is conducted, said first cooling fluid being conducted within a cavity of said heat exchanger external to said plurality of tubes.

13. The cooling system of claim 12, further comprising:

a conduit disposed within said heat exchanger and in thermal communication with said second cooling fluid.

14. The cooling system of claim 13, wherein:

said conduit is connected in fluid communication with a lubrication system of said internal combustion engine to conduct a liquid lubricant through said conduit in thermal communication with said second cooling fluid.

15. The cooling system of claim 14, wherein:

said conduit comprises a helical tubular structure disposed in an end portion of said heat exchanger.

16. The cooling system of claim 15, wherein:

said heat exchanger is disposed within said cavity formed within said intake manifold, whereby an internal surface of said cavity serves as an outer shell of said heat exchanger, heat being transferred from said first cooling fluid to said second cooling fluid within said heat exchanger.

17. A cooling system for a marine propulsion system, comprising:

an internal combustion engine having a plurality of cylinders, said plurality of cylinders being disposed in a V-shaped configuration with at least a first one of said plurality of cylinders being disposed on a first side of said V-shaped configuration and at least a second one of said plurality of cylinders being disposed on a second side of said V-shaped configuration;

a coolant passage formed within said internal combustion engine to conduct a first cooling fluid in thermal communication with a heat producing component of said internal combustion engine;

a heat exchanger connected in fluid communication with said coolant passage and in fluid communication with a source of a second cooling fluid, said second cooling fluid being water drawn from a body of water in which said marine propulsion system is operated, said heat exchanger being configured to conduct said first and second cooling fluids in thermal communication with each other, said heat exchanger being disposed between said first and second sides of said V-shaped configuration of cylinders, said heat exchanger being configured to conduct said first cooling fluid within a closed circuit comprising said heat exchanger and said coolant passage;

an intake manifold disposed at least partially between said first and second sides of said V-shaped configuration of cylinders; and a cavity formed within said intake manifold and shaped to receive said beat exchanger therein, said heat exchanger comprises a plurality of tubes within which said second cooling flow is conducted, said first cooling fluid being conducted within a cavity of said heat exchanger external to said plurality of tubes, said heat exchanger is disposed within said cavity formed within said intake manifold, whereby an internal surface of said cavity serves as an outer shell of said heat exchanger, heat being transferred from said first cooling fluid to said second cooling fluid within said heat exchanger, said plurality of tubes being disposed along an axis which is generally parallel to a crankshaft of said internal combustion engine.

18. The cooling system of claim 17, further comprising:

a conduit disposed within said heat exchanger and in thermal communication with said second cooling fluid, said conduit being connected in fluid communication with a lubrication system of said internal combustion engine to conduct a liquid lubricant through said conduit in thermal communication with said second cooling fluid, said conduit comprising a helical tubular structure disposed in an end portion of said heat exchanger.

* * * * *